US007618282B2

(12) United States Patent
Wu et al.

(10) Patent No.: US 7,618,282 B2
(45) Date of Patent: Nov. 17, 2009

(54) SNAP-FIT FLAT CABLE CONNECTOR ASSEMBLY

(75) Inventors: Lin Wu, Tu-cheng (TW); Wei-Ya Cheng, Kunshan (CN); David Tso-Chin Ko, Cypress, CA (US); Hai-Wei Wang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/074,334

(22) Filed: Mar. 3, 2008

(65) Prior Publication Data

US 2008/0214041 A1 Sep. 4, 2008

(51) Int. Cl.
*H01R 12/24* (2006.01)

(52) U.S. Cl. ..... 439/496; 439/499

(58) Field of Classification Search ..... 439/496, 439/499, 492, 329

See application file for complete search history.

(56) References Cited

U.S. PATENT DOCUMENTS 5,403,202 A * 4/1995 Roehling ..... 439/493
5,690,510 A * 11/1997 Chishima ..... 439/496
6,299,476 B1 * 10/2001 Schramme et al. ..... 439/496
6,648,668 B1 * 11/2003 Ko ..... 439/353
2002/0142647 A1 * 10/2002 Aoki ..... 439/496

FOREIGN PATENT DOCUMENTS

CN 1624982 A 6/2005

* cited by examiner

*Primary Examiner*—Edwin A. Leon
*Assistant Examiner*—Vanessa Girardi
(74) *Attorney, Agent, or Firm*—Wei Te Chung; Andrew C. Cheng; Ming Chieh Chang

(57) ABSTRACT

A cable connector assembly in accordance with the present invention comprises an insulative housing defining a base portion having a front surface and a rear surface, a mating portion extending from the front surface, and a receiving space recessed into the rear surface, a plurality of passageways formed in the mating portion and communicated with the receiving space. And a plurality of terminals assembled in the insulative housing have a mating section arranged in the passageways and a contacting section extending into the receiving space. A supporting member assembled to the insulative housing comprises a base portion and a tongue portion extending forwardly from the base portion and received in the receiving space. And a flexible flat cable defines a forward end having a mating portion well-supported by a upper and a lower surface of the tongue portion and depressed by a upper and a lower inner surface of the receiving space, and the mating portion of the forward end supported by the upper surface of the tongue portion is electrically connected with the contacting section of the terminal extending into the receiving space.

19 Claims, 7 Drawing Sheets

SNAP-FIT FLAT CABLE CONNECTOR ASSEMBLY

FIELD OF THE INVENTION

The present invention relates to cable connector assembly, and more particularly to a kind of cable connector assembly that the cable is firmly positioned in the cable connector assembly.

DESCRIPTION OF PRIOR ART

China Patent Publication No. 1624928A discloses a cable connector assembly, please referring to FIGS. 3 and 5, the cable connector assembly includes an insulative housing 30, a plurality of terminals 31 disposed in the insulative housing 30, a cable supporting member 20 assembled to the housing 30 and a flexible flat cable (FFC) 10 supported by the cable supporting member 20 and electrically contacted to the terminals 31. Furthermore, a reinforce plate 13 disposed on the lower surface of the FFC 40 interfering with a bar portion 23 extended from upper surface of the cable supporting member 20. In this case, the FFC 10 positioned in the cable connector assembly deserves not only the pressure by the terminals 31, but also the resistance by the bar portion 23, so that the FFC 10 is positioned in the cable connector assembly.

Whereas, the interference area between the reinforce plate 13 and the bar portion 23 is small, thus, when the FFC 10 is deserved by the large pull force especially along the inclined direction, the FFC 10 would be splited from the reinforce plate 13, thereby influencing the electrically contact between the terminals and the FFC 10. In addition, the reinforce plate 13 still needs to be pasted to the lower surface of the FFC 10, thus the process of the cable connector assembly is relatively complex and increasing the cost of the cable connector assembly.

As discussed above, an improved cable connector assembly overcoming the shortages of existing technology is needed.

SUMMARY OF THE INVENTION

Accordingly, an object of the present invention is to provide a kind of the cable connector assembly to meet the requirements of firmly positioning the cable and preventing the cable from being pulled outwardly by the outer pulling force easily in any direction.

In order to achieve the above-mentioned object, a cable connector assembly in accordance with the present invention comprises comprises an insulative housing defining a base portion having a front surface and a rear surface, a mating portion extending from the front surface, and a receiving space recessed into the rear surface, a plurality of passageways formed in the mating portion and communicated with the receiving space. A plurality of terminals assembled in the insulative housing have a mating section arranged in the passageways and a contacting section extending into the receiving space. A supporting member assembled to the insulative housing comprises a base portion and a tongue portion extending forwardly from the base portion and received in the receiving space. And a flexible flat cable defines a forward end having a mating portion well-supported by a upper and a lower surface of the tongue portion and depressed by a upper and a lower inner surface of the receiving space, and the mating portion of the forward end supported by the upper surface of the tongue portion is electrically connected with the contacting section of the terminal extending into the receiving space.

Other objects, features and advantages of the invention will be apparent from the following detailed description taken in connection with the accompanying drawings.

DETAILED DESCRIPTION OF PREFERRED EMBODIMENTS

Figure 1:
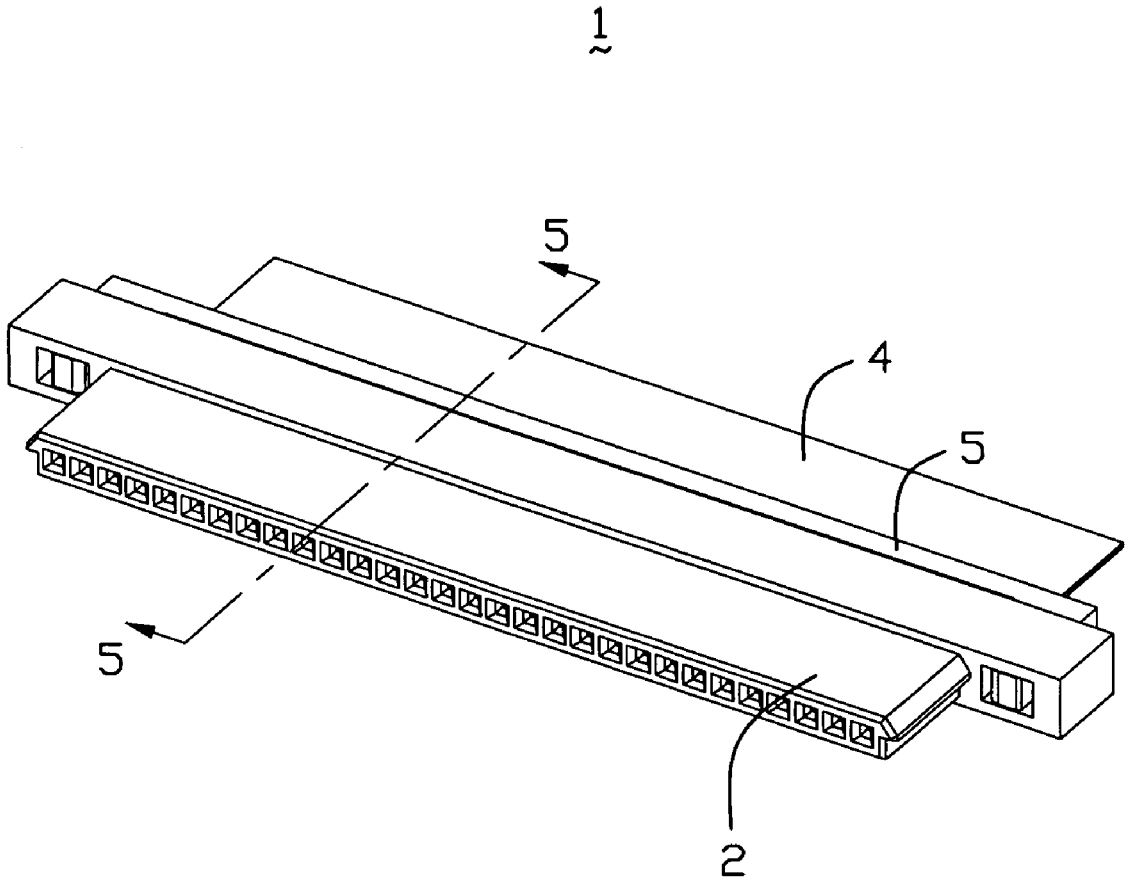
FIG. 1 is a perspective view of a cable connector assembly made in accordance with the present invention.

Reference will now be made to the drawing figures to describe the present invention in detail.

Referring to FIGS. 1 to 3 and FIGS. 5, a cable connector assembly 1 in accordance with the present invention includes an insulative housing 2, a plurality of terminals 3 received into the insulative housing 2, a flexible flat cable (FFC) 4 electrically connected to the terminals 3 and a supporting member 5 supporting the flexible flat cable 4 and locking with the insulative housing 2.

Referring to FIGS. 2 to 3 and FIGS. 6 to 7, an insulative housing 2 includes a rectangular base portion 21 having a front surface and a rear surface and extending along the widthwise direction, and a mating portion 22 extending forwardly from the front surface of the base portion 21 to be mated with the complementary connector (not shown in FIGS.).

A receiving space 210 recessed into the rear surface of the base portion 21 extending along the widthwise direction into which the flexible flat cable 4 and the supporting member 5 are to be inserted. A plurality of upper separators 2102 (rib-like structure) extends downwardly along the longitudinal direction from the upper inner surface of the receiving space 210 arranged side by side in the direction of the width of the insulative housing 2, and a plurality of lower separators 2103 extends upwardly along the longitudinal direction from the lower inner surface of the receiving space 210 respectively corresponding with the upper separators 2102. A shoulder 2104 extrudes upwardly from the top surface of the lower separator 2103 making the cross section of the lower separator 2103 to be step shape, thus the lower inner surface of receiving space 210 can be seen as to be step shape. A few of upper slots 2100 formed between the adjacent upper separators 2102 are corresponding with the lower slots 2101 formed between the adjacent lower separators 2103. The upper slots 2100 and lower slots 2101 are used to receiving a portion of the terminal 3. A pair of rectangular holes 211 disposed in the opposite sides in the widthwise direction of the base portion 21 extend through the opposite front and rear surface of the base portion 21 along the longitudinal direction. And a pair of lock projections 2111 are respectively formed on the inner surface 2110 of the holes 211 for locking with the supporting member 5.

The mating portion 22 defines a plurality of passageways 220 arranged side by side in the direction of the width of the insulative housing 2. These passageways 220 are opened from the front surface of the mating portion 22 and communicated with the receiving space 210 of the base portion 21. Each of the passageways 220 is respectively communicated with a upper slot 2100 and a lower slot 2101.

Referring to FIGS. 2 to 5, a plurality of terminals 3 are assembled to the housing 2. The terminal 3 includes a flat bottom wall 30, two opposite left and right side walls 31 bent upwardly from opposite edges of the bottom wall 30 and a top wall 32 bent rightwardly from the top end of the left wall 31 and paralleled with the bottom wall 30. Furthermore, the flat bottom wall 30 of the terminal 3 defines a front portion 301 received in the passageways 220 of the mating portion 22 and a rear portion 302 received in the lower slot 2101 and bending downwardly from the rear end of front portion 301 firstly and then extending backwardly. A protrusion portion 3021 extrudes from the upper surface of the rear portion 302 is used to support a forward end of the flexible flat cable. The front portion of the left and right side walls 31 can be seen as a pair of resilient mating sections 311 opposite to each other. The mating section 311 can be electrically connected to the contacts (not shown in FIGS.) received in the complementary connector (not shown in FIGS.). The rear portion of the left and right side walls 31 can be seen as a securing section 312 with a plurality of serrated protrusion 3121 thereof secured with the passageway 220. A contacting section 321 is formed on the rear portion of the top wall 32 of the terminal 3 for contacting with the flexible flat cable 4.

Figure 2:
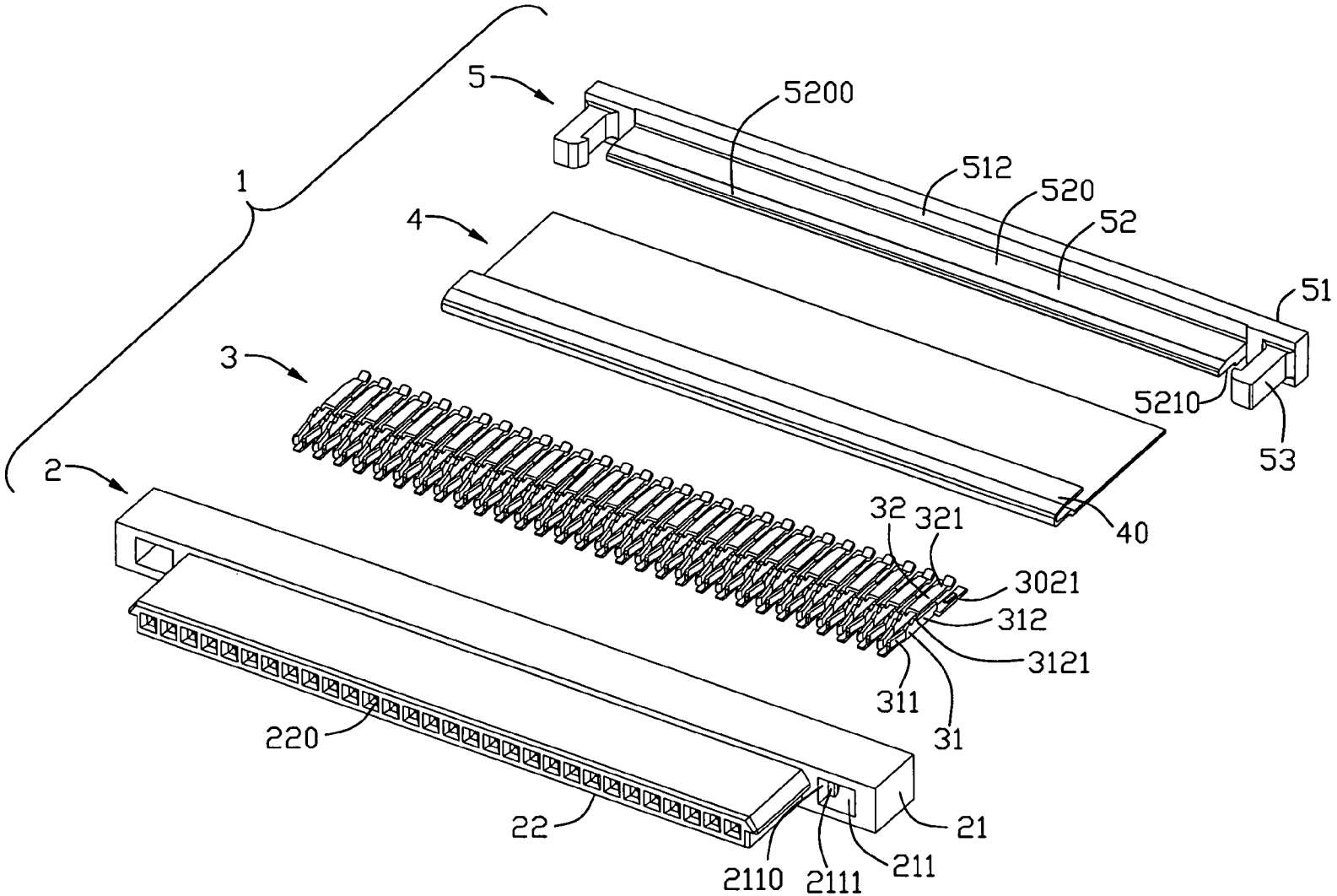
FIG. 2 is an exploded, perspective view of the cable connector assembly of FIG. 1.
Figure 3:
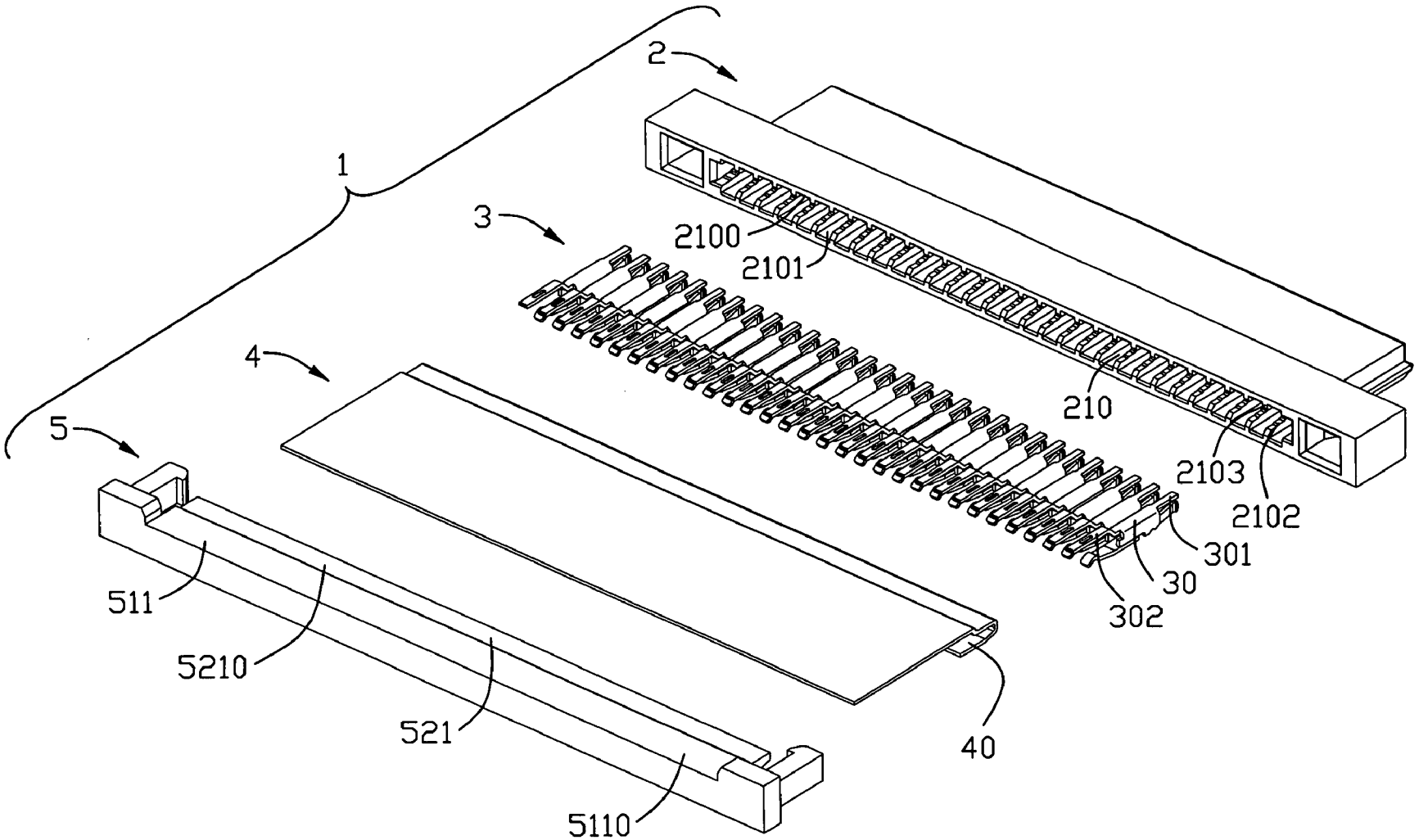
FIG. 3 is an exploded, perspective view of the cable connector assembly in another point of view different from FIG. 2.

Referring to FIGS. 2 to 3, a supporting member 5 assembled to the insulative housing 2 includes a base portion 51, a tongue portion 52 extending forwardly from the base portion 51 and a pair of latch portions 53 extending forwardly from two opposite sides of the base portion 51. A groove 511 formed on the base portion 51 extends in the longitudinal direction through the front and rear surface of the base portion 51, thus a bottom surface 5110 is formed in the bottom of the groove 511, further a recess 512 is formed on the front surface of the base portion 51 having a predetermined width. The tongue portion 52 defines opposite upper surface 520 and lower surface 521 for supporting the forward end of the flexible flat cable 4. The lower surface 521 of the tongue portion 52 and the bottom surface 5110 of the groove 511 are in the common surface. Further, the tongue portion 52 defines a chamfer 5200 at the front end of the upper surface 520 and a groove 5210 at the front end of the lower surface 521, thus the lower surface 521 is seen to be step shape. The lower surface 521 of the tongue portion 52 and the bottom surface 5110 of the groove 511 can be seen as the lower supporting surface 54 of the supporting member 5, and the upper surface 520 of the tongue portion 52 can be seen as the upper supporting surface 55 of the supporting member 5. A pair of latch portion 53 respectively defines a hook at the free end of the latch portion 53 engaged with the lock projections 2111 formed on the holes 211, thus the insulative housing 2 and the supporting member 5 can be assembled and locked together.

Figure 4:
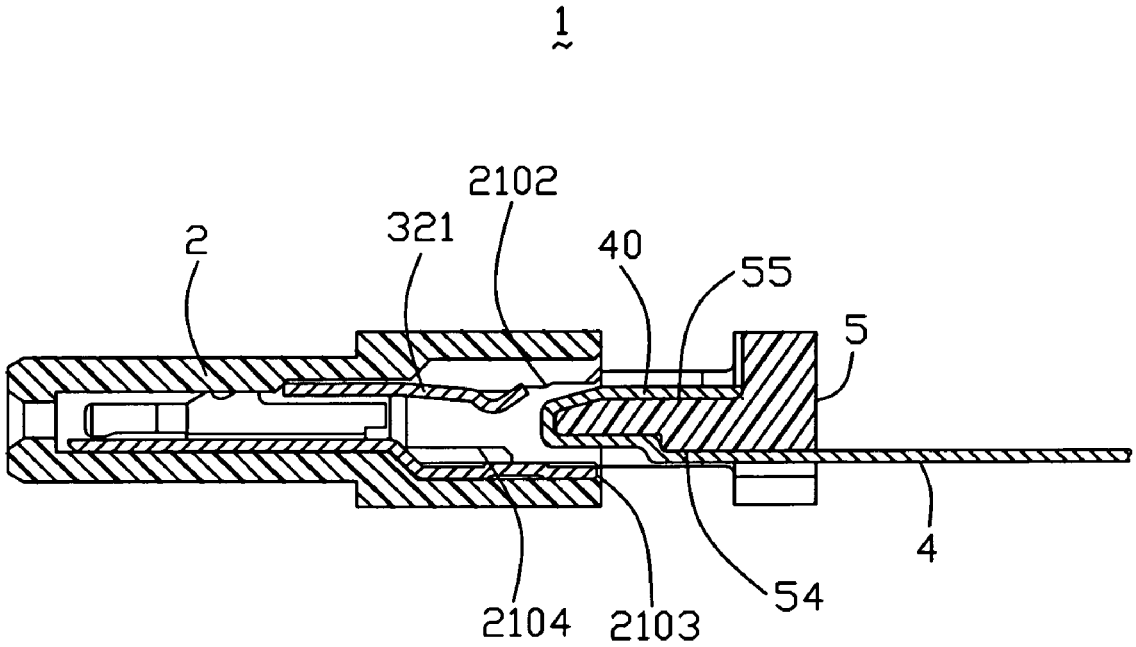
FIG. 4 is a partial decomposition cross-sectional view of the cable connector assembly made in accordance with the present invention.
Figure 5:
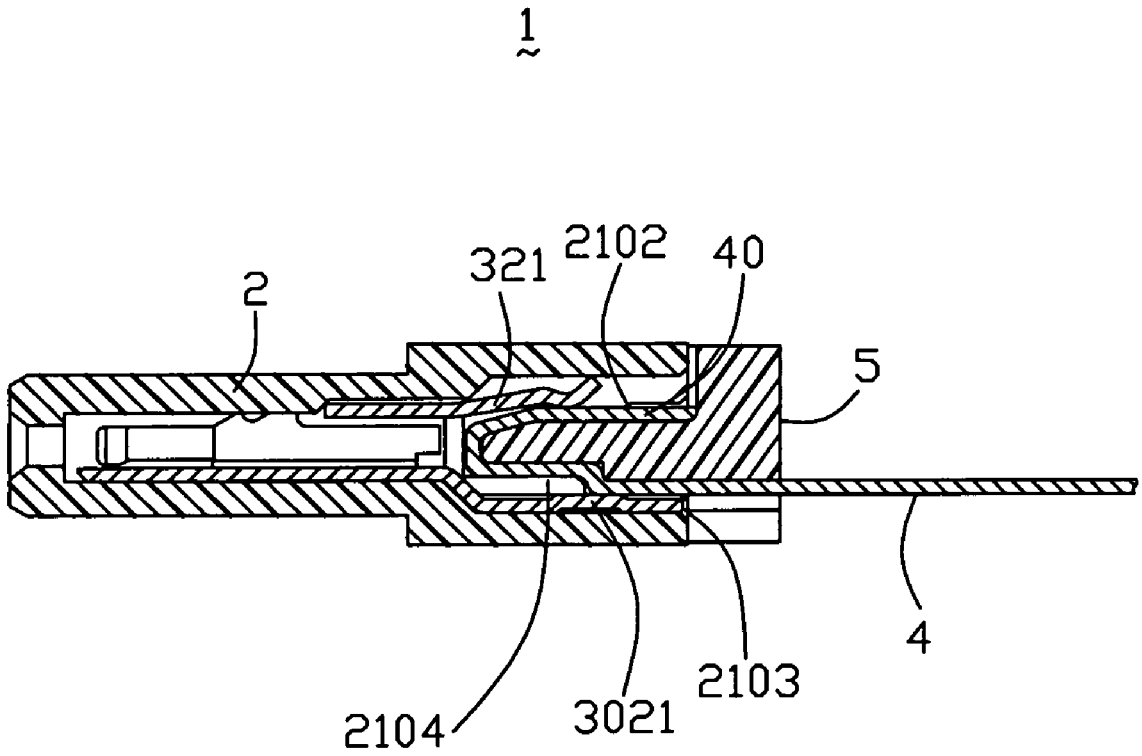
FIG. 5 is a cross-sectional view of the cable connector assembly taken along line 5-5 of FIG. 1.
Figure 6:
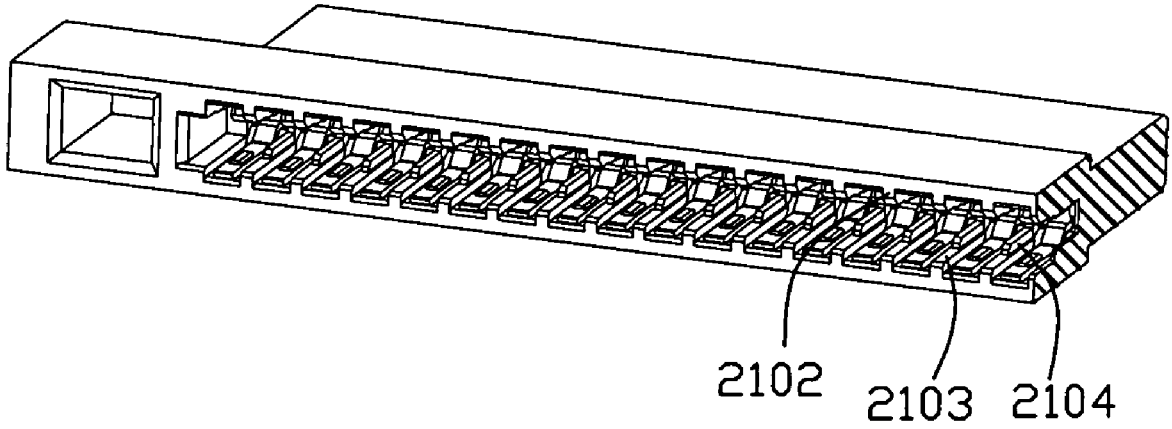
FIG. 6 is a rear and right cross-section view of the housing with the terminal made in accordance with the present invention.
Figure 7:
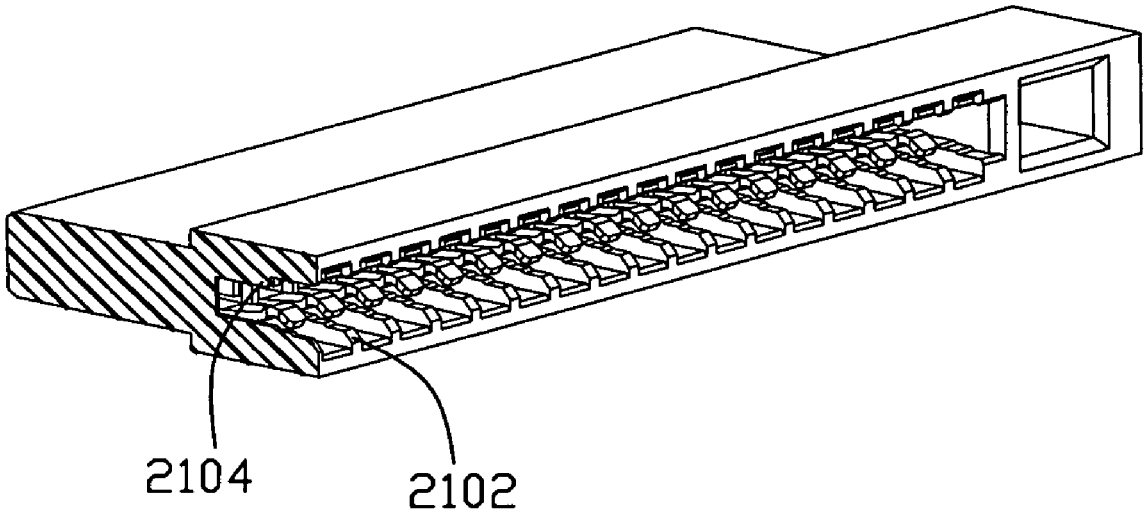
FIG. 7 is a cross-section view of the housing with the terminal in another point of view different from FIG. 6.

Referring to FIGS. 4 to 5, the flexible flat cable 4 can be wound or hooked on the tongue portion 52. The forward end of the flexible flat cable 4 defines a mating portion 40 supported by the upper surface 520 of the tongue portion 52. A plurality of conductors (not shown in FIGS.) arranged side by side on the mating portion 40 in widthwise direction are exposed and can be electrically connected to the contacting section 321 of the terminal 3.

The assembling process of the cable connector assembly 1 in according to the present invention starts from assembling the terminals 3 into the insulative housing 2. In this case, the front potion 301 of the flat bottom wall 30 and the left and right side walls 31 of the terminal 3 are received into the passageways 220 of the mating portion 22. The securing section 312 of the left and right side walls 31 is secured with the passageway 220 by the serrated protrusion 3121 thereof and making the terminal 3 to be positioned in the insulative housing 2. The contacting section 321 of the top portion 32 of the terminal 3 is received in the upper slots 2100 and the free end of the contacting section 321 extends out of the upper slots 2100.

After the terminals are assembled to the insulative housing 2, then winding the flexible flat cable 4 to the supporting member 5 along the opposite surface of the tongue portion 52 so as to be arranged from the lower surface 521 to the upper surface 520 of the tongue portion 52. In this case, the mating portion 40 of the flexible flat cable 4 supported by the upper surface 520 of the tongue portion 52 has a free end 401 disposed in the recess 512 for positioning the flexible flat cable 4 in widthwise direction.

At last, pushing the flexible flat cable 4 together with the supporting member 5 into the insulative housing 2 assembled with terminals 3. In this case, a pair of the latch portion 53 of the supporting member 5 are inserted into the holes 211, then the hook of the latch portion 53 is engaged with the lock projection 2111. At the same time, the tongue portion 52 of the supporting member 5 with the forward end of flexible flat cable are received into the receiving space 210 of the base portion 21. Wherein the chamfer 5200 at the front end of the upper surface 520 can make the contacting section 321 of the terminal 3 smoothly contact with the conductor in the mating portion 40 when the tongue portion 52 and the forward end of the flexible flat cable 4 are pushed into the receiving space 210 together. When the tongue portion 52 and the the forward end of the flexible flat cable 4 are fully inserted into the receiving space 210, the mating portion 40 of the flexible flat cable 4 is depressed by the contacting section 321 of the top portion 32 of the terminals 3 and separators 2102 formed on the upper inner surface of the receiving space 210. The forward end of flexible flat cable 4 supported by the lower surface 521 of the tongue portion 52 is also depressed by the protrusion portion 3021 of the bottom wall 30 of the terminal 3 and the separators 2103 formed on the lower inner surface of the receiving space 210 and the shoulder 2104 thereof is also received into the groove 5210. The forward end of the flexible flat cable 4 is fitted around the tougue portion 52 by the pressure from the insulative housing 2 and terminals 3. As the step shaped separators 2103 mating to the step shaped lower surface 521 of the tongue portion 52, a step shaped path is formed between the top surface of the separators 2103 and lower surface 521 of the tongue portion 52 (shown in FIG. 5). Thus the forward end of the flexible flat cable 4 supported by the lower surface 521 is bent to "Z" shape or step shape. Through the above assembling steps, the cable connector assembly 1 has been assembled completely.

As discussed above, the flexible flat cable 4 is firmly positioned in the cable connector assembly 1 due to the pressure from the inner surface of the receiving space 210 of the housing 2 and the contacting section of the terminals 3. In addition, the step shaped path formed in the cable connector assembly 1 can further prevent the flexible flat cable 4 from being pulling outwardly from the insulative housing 2 easily by the outer pulling force in any direction.

In another embodiment (not shown in FIGS.), the flexible flat cable 4 wound or hooked on the supporting member 5 along the opposite surfaces of the tongue portion 52 can also be arranged firstly from the upper surface 520 of the tongue portion 52 and then to the lower surface 520 thereof. The forward end of the flexible flat cable 4 also includes a mating portion 40 supported by the upper surface 520 of the tongue portion 52 where the conductors are exposed. The conductors can be electrically connected to the contacting section 321 of the terminal 3. Thus, the flexible flat cable is also firmly positioned in the cable connector assembly 1.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What we claimed is:

1. A cable connector assembly, comprising:

an insulative housing, defining a base portion having a front surface and a rear surface, a mating portion extending from the front surface, and a receiving space recessed into the rear surface, a plurality of passageways formed in the mating portion and communicated with the receiving space;

a plurality of terminals assembled in the insulative housing, having a mating section arranged in the passageways and a contacting section extending into the receiving space;

a supporting member interlocked with the insulative housing, the supporting member comprising a base portion with a front surface, a tongue portion extending forwardly from the front surface of the base portion and a pair of latch portions extending forwardly from the front surface of the base portion and disposed at two sides of the tongue portion, the tongue portion being received in the receiving space; and a flexible flat cable, defining a forward end having a mating portion well-supported by an upper and a lower surface of the tongue portion and depressed by an upper and a lower inner surface of the receiving space, and the mating portion of the forward end supported by the upper surface of the tongue portion is electrically connected with the contacting section of the terminal extending into the receiving space.

2. The cable connector assembly as recited in claim 1, wherein the terminal further comprises a securing section with a plurality of serrated protrusions thereof secured within the passageway of the mating portion of the insulative housing.

3. The cable connector assembly as recited in claim 1, wherein a recess is formed on the front surface of the base portion of the supporting member for receiving a free end of the mating portion of the flexible flat cable.

4. The cable assembly as recited in claim 1, wherein the mating portion of the flexible flat cable defines a plurality of conductors exposed and electrically connected with the contacting section of the terminal.

5. The cable connector assembly as recited in claim 1, wherein a pair of holes are disposed in two opposite sides of the base portion of the insulative housing, and a pair of lock projections are respectively formed on an inner surface of the pair of holes and engaged with the pair of latch portions of the supporting member.

6. The cable connector assembly as recited in claim 1, wherein a plurality of upper and lower separators are respectively formed on the upper and lower inner surface of the receiving space and a shoulder is formed on the top surface of the lower separator so that the cross section of the lower separator is step shape.

7. The cable assembly as recited in claim 6, wherein a plurality of upper slots are formed between the adjacent upper separators for receiving the contacting section of the terminal.

8. The cable connector assembly as recited in claim 6, wherein a groove is formed on the lower surface of the tongue portion mating with the shoulder of the lower separator so that the forward end supported by the lower surface of the tongue portion is bent to be step shape.

9. The cable connector assembly as recited in claim 6, wherein a chamfer is formed at the front end of the upper surface of the tongue portion.

10. An electrical cable assembly, comprising:

an insulative housing, defining a base portion having a front surface and a rear surface, a mating portion extending from the front surface, and a receiving space recessed into the rear surface having a step shaped lower inner surface, a plurality of passageways formed in the mating portion and communicated with the receiving space;

a plurality of terminals assembled in the insulative housing defining a mating section arranged in the passageways and a contacting section extending into the receiving space;

a supporting member, comprising a base portion and a tongue portion extending forwardly from the base portion and received in the receiving space, and a lower surface of the tongue portion is step shaped; and a flexible flat cable, defining a forward end wrapped an the tongue portion along opposite upper and lower surfaces, a step shaped path is provided between the lower inner surface of the receiving space and the lower inner surface of the tongue portion, and the forward end of the flexible flat cable disposed in the step shaped path is bent to be step shape.

11. The cable assembly as recited in claim 10, wherein a forward end comprises a mating portion supported by the upper surface of the tongue portion electrically connected with the contacting section of the terminal.

12. The cable connector assembly as recited in claim 10, wherein the terminal further comprises a securing section with a plurality of serrated protrusions thereof secured within the passageway of the mating portion.

13. The cable connector assembly as recited in claim 10 wherein a pair of holes are disposed in two opposite sides of the base portion of the supporting member, and a pair of lock projections are respectively formed on inner surface of the pair of holes.

14. The cable connector assembly as recited in claim 13, wherein the supporting member further comprises a pair of latch portions extending forwardly from two opposite sides of the base portion and locked with the lock projections in the holes of the base portion of the insulative housing.

15. A cable connector assembly comprising:

an insulative housing defining a front mating portion with a plurality of passageways therein and a rear base portion with a common cavity therein;

a plurality of contacts each having a front mating portion disposed in the corresponding passageway and a rear tail portion disposed in the cavity;

a supporting member assembled to a rear portion of the housing and defining a forwardly extending tongue portion thereof;

a flat flexible cable having a front portion having exposed conductors thereon and wrapping the tongue portion; wherein the tongue portion with the wrapping front portion of cable is inserted into the cavity under a condition that each of said conductors is mechanically and electrically engaged with the corresponding contact on opposite surfaces of said tongue portion, and the wrapping front portion is further depressed by at least one inner surface of the housing in the cavity.

16. The cable connector assembly as claimed in claim 15, wherein said a section of the wrapping front portion is bent to step shape when the tongue portion hilly received into the cavity

17. The cable connector assembly as claimed in claim 15, wherein said wrapping front portion is depressed by opposite inner surfaces of the housing in the cavity.

18. The cable connector assembly as claimed in claim 15, wherein said at least one inner surface is formed with a shoulder to engage the wrapping front portion under condition that said shoulder is spaced from a rear face of the housing.

19. The cable connector assembly as claimed in claim 15, wherein said wrapping front portion engages the at least one inner surface in a vertical direction perpendicular to an insertion direction of the support member.

* * * * *